US007360477B2

(12) United States Patent
Hess

(10) Patent No.: US 7,360,477 B2
(45) Date of Patent: Apr. 22, 2008

(54) ROPE-LIKE STRUCTURE

(75) Inventor: Ruedi Hess, Tegerfelden (CH)

(73) Assignee: Textilma AG, Stansstad (CH)

( * ) Notice: Subject to any disclaimer, the term of this patent is extended or adjusted under 35 U.S.C. 154(b) by 0 days.

(21) Appl. No.: 10/490,429

(22) PCT Filed: Sep. 24, 2002

(86) PCT No.: PCT/CH02/00533

§ 371 (c)(1),
(2), (4) Date: Sep. 1, 2004

(87) PCT Pub. No.: WO03/027383

PCT Pub. Date: Apr. 3, 2003

(65) Prior Publication Data

US 2005/0011344 A1 Jan. 20, 2005

(30) Foreign Application Priority Data

Sep. 25, 2001 (CH) ..... 1770/01

(51) Int. Cl.
*D04C 1/12* (2006.01)

(52) U.S. Cl. ..... 87/6; 87/13; 57/210

(58) Field of Classification Search ..... 87/6–9, 87/13; 57/210, 230
See application file for complete search history.

(56) References Cited

U.S. PATENT DOCUMENTS 4,170,921 A 10/1979 Repass
4,312,260 A 1/1982 Morieras
4,640,178 A 2/1987 Kurzbock
5,358,262 A * 10/1994 Roberts ..... 277/652
5,934,168 A * 8/1999 Feichtinger et al. ..... 87/8
6,283,004 B1 * 9/2001 Tseng ..... 87/6
2002/0083820 A1 * 7/2002 Greenhalgh ..... 87/8
2003/0005681 A1 * 1/2003 He et al. ..... 57/210

FOREIGN PATENT DOCUMENTS

DE 4035814 A 5/1992
FR 2402736 4/1979

OTHER PUBLICATIONS

Textile Terms and Definitions, Jun. 2002, The Textile Institute, 11th edition, p. 182.*

* cited by examiner

*Primary Examiner*—Shaun R. Hurley
(74) *Attorney, Agent, or Firm*—Buchanan Ingersoll & Rooney PC

(57) ABSTRACT

Rope-like structures, in particular, kernmantel ropes, cords and cables in which the individual fibres, threads or thread bundles are connected to each other such that the above are non-slip relative to each other. Such rope-like bodies have an improved resistance to extension and an improved knot stability. Kernmantel ropes have a proportion of the core fibres in the sheath region and connected therein to the sheath fibres, while a proportion of the sheath fibres lie in the core region and are connected therein to the core fibres, such that the at least one sheath is fixed to the at least one core, such that the above are non-slip relative to each other. Cords and cables with similar properties are disclosed. Such ropes are applicable in the field of work security, in water, sailing and mountain sports and for the fire service, army, police and rescue units and in Jacquard machines.

24 Claims, 4 Drawing Sheets

ROPE-LIKE STRUCTURE

The invention relates to rope-like structures

U.S. Pat. No. 4,640,178 discloses a kernmantel rope that combines a plurality of core fiber bundles into a core and is surrounded by an intermediate sheath. The intermediate sheath is surrounded by an external sheath of braided monofilament fibers. Core, intermediate sheath and sheath are not connected to each other and therefore slide relative to each other, which has a negative impact on the use of the kernmantel rope.

U.S. Pat. No. 4,170,921 discloses a kernmantel rope that is comprised of a braided core that in turn is comprised of a plurality of core fiber bundles. The core is surrounded by a braided sheath. Core and sheath are not connected to each other and therefore are not slip-resistant. During the use of the rope thick or thin areas result, which is disadvantageous.

The object of the present invention is to provide a rope-like structure or a rope-like design in which the individual fibers, threads or thread bundles are connected to each other so that the fibers, threads or thread bundles are non-slip relative to each other which will avoid said disadvantages. Another object is to describe various possible uses of such rope-like structures.

The invention is described in greater detail in the following paragraphs and reference is being made to the accompanying Figures in which:

FIG. 1 shows a cross-section of the schematic design of a kernmantel rope

FIG. 2 shows a cross-section of the schematic design of a kernmantel rope with an intermediate sheath FIG. 3 shows a first exemplary embodiment of a kernmantel rope comprised of high-performance fibers FIG. 4 shows a second exemplary embodiment of a kernmantel rope as a dynamic rope FIG. 5 shows a third exemplary embodiment of a kernmantel rope as a static rope FIG. 6 shows a fourth exemplary embodiment of a kernmantel rope as a dynamic rope with an intermediate sheath FIG. 7 shows a section of a kernmantel rope with ratings FIG. 8 shows a fifth exemplary embodiment of kernmantel rope with an intermediate sheath FIG. 9 shows a schematic design of a cord in accordance with the invention FIG. 10 shows increased strength in the resistance to extension of the cord FIG. 11 shows increased knot stability of the cord FIG. 12 shows a cord with a fishbone-like pattern FIG. 1 shows a cross-section of the schematic design of a kernmantel rope in accordance with the invention. A kernmantel rope 10 has an internal core region 1 and a surrounding sheath region 2. The core region 1 is comprised of at least one core 3 that in turn is comprised of a plurality of fibers, threads or thread bundles whereby the latter collectively are referred to as so-called core fibers 5. The sheath region 2 is comprised of a sheath 4 that in turn is comprised of a plurality of fibers, threads or thread bundles whereby the latter collectively are referred to as so-called sheath fibers 6.

The core region 1 can be comprised of several cores, e.g. three or five, equipped with the same type or different types of core fibers.

A proportion of the core fibers 5, called core fibers 5', is located in the sheath region 2 and connected therein to the sheath fibers 6 while a proportion of the sheath fibers 6, called sheath fibers 6', is arranged in the core region 1 and connected therein to the core fibers 3. This ensures that the sheath is connected in a non-slip manner relative to at least one core.

The slipping of the sheath on the core—as already explained—is a known but highly undesirable property in kernmantel ropes. The design in accordance with the invention prevents any slipping motion and therefore provides significant advantages.

In an advantageous manner the rope runs evenly when gliding over carabiners, castors and reels. There are no thick or thin spots that customarily occur when the sheath slides. Such kernmantel ropes could be used instead of turned ropes.

FIG. 2 shows a cross-section of the schematic design of a kernmantel rope with an intermediate sheath. A kernmantel rope 20 has an inner core region 1, a surrounding sheath region 2, at least one core 3 with core fibers 5 and a sheath 4 with sheath fibers 6, as already described in FIG. 1. Between the inner core region 1 and the sheath region 2 an intermediate sheath region 7 is arranged. This intermediate sheath region 7 is comprised of an intermediate sheath 8 that in turn is comprised of a plurality of fibers, threads or thread bundles whereby the later collectively are referred to as so-called intermediate sheath fibers 9.

A proportion of the core fibers 5, referred to as core fibers 5', is arranged in the intermediate sheath region 7 and connected therein to the intermediate sheath fibers 9, while a proportion of the intermediate sheath fibers 9, referred to as intermediate sheath fibers 9', is arranged in the core region 1 and connected therein to the core fibers 3.

A proportion of the intermediate sheath fibers 9, referred to as intermediate sheath fibers 9', is arranged in sheath region 2 and connected therein to sheath fibers 4, while a proportion of the sheath fibers 6, referred to as sheath fibers 6', is arranged in the intermediate sheath region 7 and connected therein to the intermediate sheath fibers 9.

Of course a proportion of the core fibers 5' can be connected in the sheath region 2 and can be connected therein to the sheath fibers 6, while a proportion of the sheath fibers 6' is arranged in core region 1 and connected therein to core fibers 3.

This means that at least one sheath is connected to at least one core in a non-slip manner.

FIG. 3 shows a first exemplary embodiment of a kernmantel rope made of high-performance fibers.

The core 3 is comprised of very high-strength high-performance fibers 5 with the lowest possible degree of extension and high resistance to tearing such as Kevlar, Dyneema, Spectra, polyester with dimensional stability (PEN). The sheath 4 is comprised of especially non-abrasive, edge-tear-resistant, shear-resistant, heat-resistant and/or flame-resistant fibers 6 such as Kevlar, Nomex, polyamide (PA) and polyester (PES).

Used as a static high-performance rope for industrial, trade or athletic applications. Also suitable as a substitute for steel ropes with frequent reversed bending or for work safety and rescue devices.

FIG. 4 shows a second exemplary embodiment of a kernmantel rope as a dynamic rope. The core 3 has many fine high-performance fibers in this region that provide for a considerably higher level of absorption of dynamic shocks. This results in improved dynamic properties with identical or reduced rope diameters as compared to known, customary ropes. The sheath fibers 6 of the sheath 4 are more resistant to abrasions, more resistant to moisture and more shear resistant so that even with various different fiber properties the sheath 4 is connected to the core 3 in a non-slip manner.

Used as a dynamic high-performance rope for athletic, industrial and trade applications with high safety shocks.

FIG. 5 shows a third exemplary embodiment of a kernmantel rope as a static rope. The core 3 has high-performance fibers 5 such as polyester (PES) and polyamide (PA) with considerably reduced extension but higher tear resistance. This results in better static properties with identical or reduced rope diameters compared to customary ropes. The sheath fibers 6 of the sheath 4 have significantly more abrasion-resistant, moisture-resistant and shear-resistant properties so that even with various different fiber properties the sheath 4 is connected to the core 3 in a non-slip manner. Used as a static high-performance rope for industrial, trade, police, armed forces or athletic applications and work safety.

FIG. 6 shows a fourth exemplary embodiment of a kernmantel rope as a dynamic rope with an intermediate sheath.

The core 3 has high-strength high-performance fibers 5 with materially reduced extension but higher tear resistance compared to today's polyamide or polyester ropes. This results in better static properties with identical or reduced rope diameters compared to customary ropes. The intermediate sheath 8 is comprised of fibers 9 that are different or identical to the fibers of the core of the sheath and have a net-like structure that allows the formation of an air cushion below the sheath 2 and, paired with the small diameters, have reduced air resistance. The core 3, the intermediate sheath 8 and the sheath 2 are connected to each other in a manner that ensures that even with completely different fiber properties the intermediate sheath 8 and the sheath 2 are connected relative to each other and to the core 3 in a non-slip manner. The resulting air cushions in the intermediate sheath ensure that the kernmantel rope, paired with the small diameter, has reduced air resistance. Such ropes are suitable for competitive sailing applications, air rescue missions and applications in which low air resistance is required.

FIG. 7 shows a section of a kernmantel rope with ratings. Incorporated in the sheath structure are important ratings such as heat resistance, breaking load, diameter, maximum extension, manufacture date, EN standard as fibers.

This not only meets an important functional aspect but also provides an advantageous embodiment that allows for an attractive design. At the same time this ensures that the attached information or labels that are customary do not get lost.

FIG. 8 shows a fifth exemplary embodiment of a kernmantel rope with an intermediate sheath. The core 3 has high-performance fibers 5 with fibers such as polyamide (PA), polyester (PES), and polyester with dimensional stability (PEN), Aramid or Dyneema. The intermediate sheath 8 is comprised of so-called absorption threads such as monofil or elastic yams that have high compression properties while the sheath 4 is comprised of sheath fibers 6 such as polypropylene, polyester or polyamides that are highly abrasion-, shear- or edge-tear-resistant.

If the core is comprised of high-strength Aramid fibers, for example, and one or several sheaths are made of heat-resistant Nomex fibers, the kernmantel rope is especially suitable for rescue operations as a heat-resistant rope for fire services and armed forces operations.

The blending or connecting of the core fibers with at least one sheath region can be restricted to a small area, i.e. less than 3%. A simultaneous blending of sheath fibers in the core region is not required.

If, however, this is the case, it is minor blending, i.e. it is less than 3%. In this case core fibers are connected in at least one sheath region while sheath fibers are connected in the core region. This above all applies to applications in dynamic and static kernmantel ropes that are used today.

Analogously the blending or the connecting of the core fibers in at least one sheath region can be moderately large, i.e. it is 3% but less than 30%. Or, the blending or connecting of the core fibers in at least one sheath region is large to maximum, i.e. it is 30% but no more than 50%.

If the blending is 50% max., i.e. 50% of the core fibers are connected in the sheath region while 50% of the sheath fibers are connected in the core region, it is hard to distinguish the core from the sheath. The connection must not necessarily be homogenous across the entire cross-section of the rope.

This consideration is even more extreme if the core and the sheath are comprised of the same fibers, threads and thread bundles.

Typical applications are use in sailboat sheets, as ropes instead of steel ropes, as load cables with reverse bending or as a substitute for turned ropes.

The embodiment of such kernmantel ropes is extremely versatile and cannot be all-inclusive here. Kernmantel ropes in accordance with the invention are used in work safety, in water, sailing and mountain sports as well as by police, fire services and armed forces.

FIG. 9 shows the schematic design of a cord in accordance with the invention. A cord 30 is comprised of individual fibers, threads or thread bundles, collectively referred to as cord fibers 11, that are connected to each other in a manner that the fibers, threads or thread bundles are non-slip relative to each other. It looks similar to a turned or braided cord, however, it has at least 10% more resistance to extension and an improved knot stability of at least 10% compared to customary cords. A positive property is the fact that the cut ends do not fray or unravel.

Figure 1:
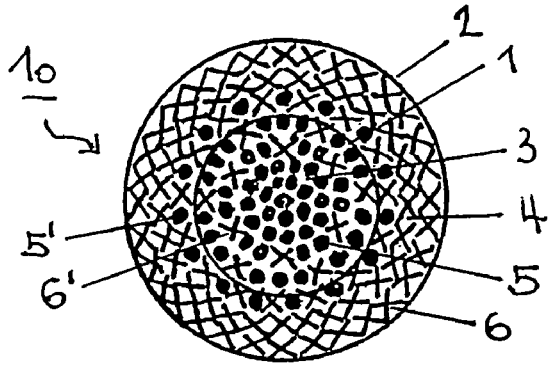
Figure 2:
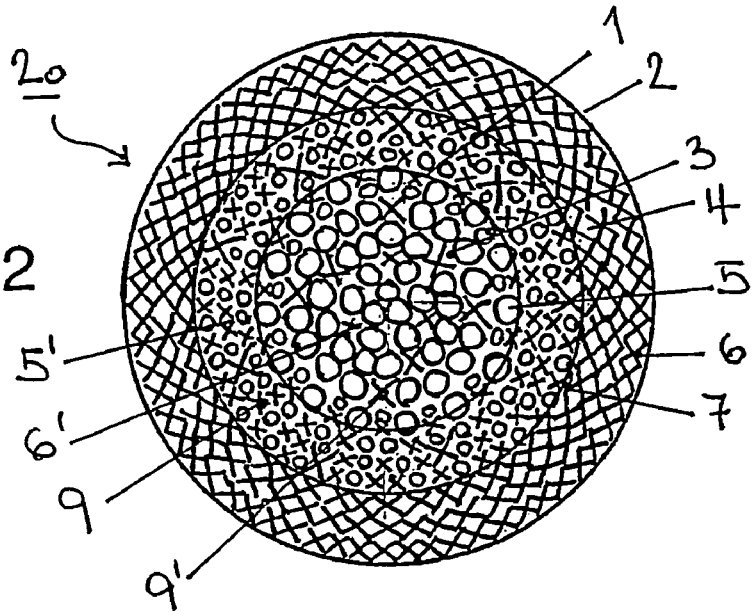
Figure 3:
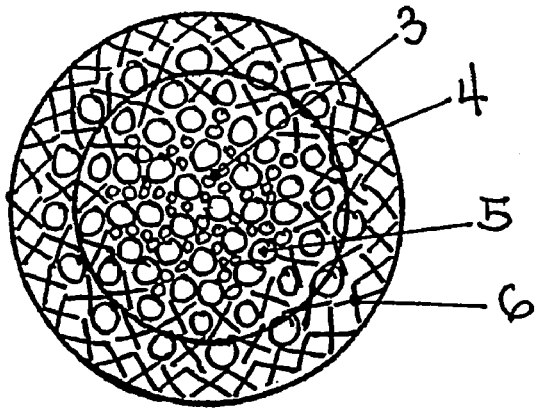
Figure 4:
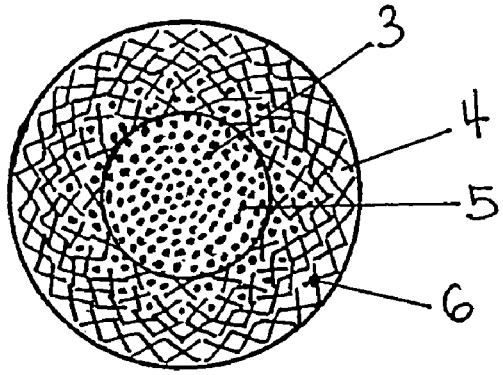
Figure 5:
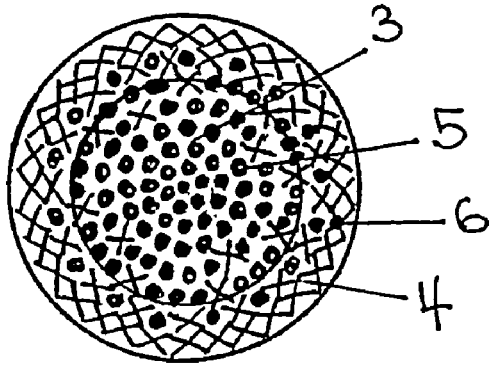
Figure 6:
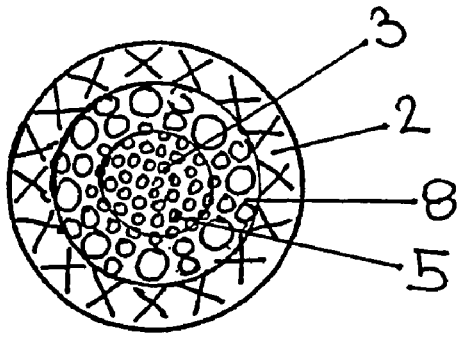
Figure 7:
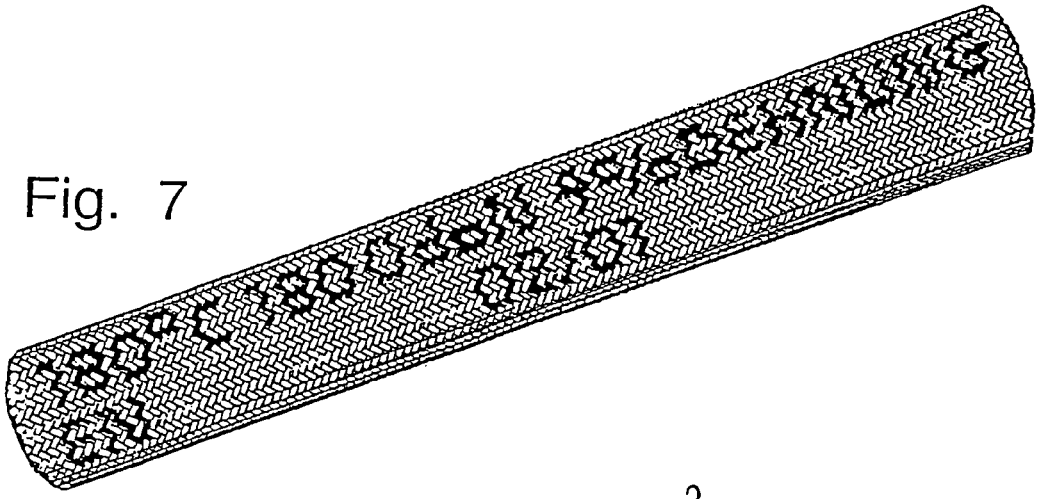
Figure 8:
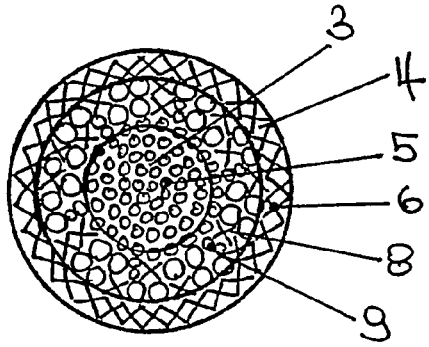
Figure 9:
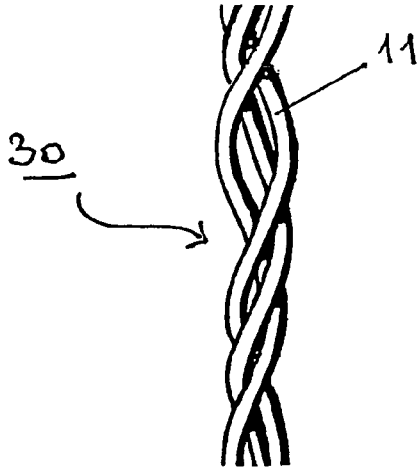
Figure 10:
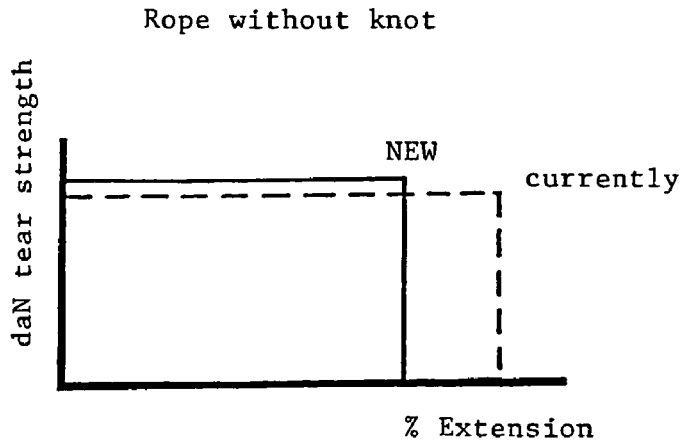
FIG. 10 shows the increased resistance to extension of the cord in accordance with the invention that is at least 10% better compared to customary cords.
Figure 11:
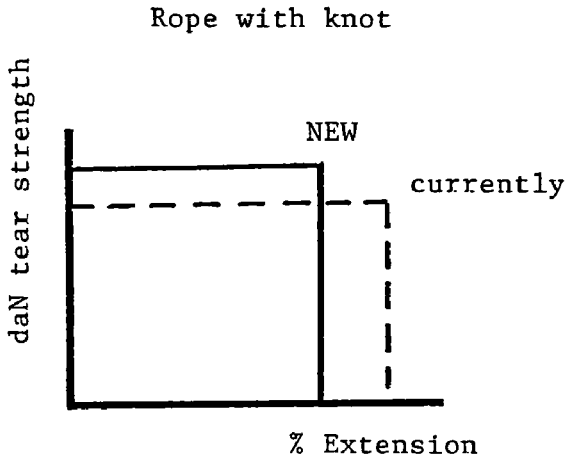
FIG. 11 shows the improved knot stability of the cord that is at least 10% better than customary cords.
Figure 12:
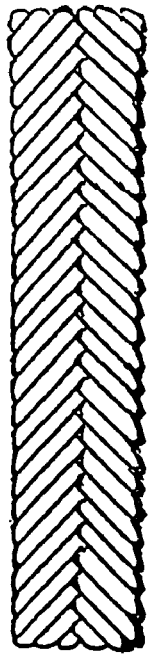

FIG. 12 shows a cord with a fishbone-like pattern. It looks similar to a turned or braided rope. This cord does not unravel when cut and does not fray, which seems especially advantageous. Similar to a kernmantel rope this cord can also be comprised of two different materials. A mixture of anti-static or colored fibers can significantly improve the desired properties. Such cords are often used as so-called harness cord in Jacquard machines and are comprised of high-performance fibers, synthetic and heat-resistant natural fibers. Typically this cord is 0.8-2.5 mm thick and also is called 'kernmantel cord' because the structure is similar to that of a kernmantel rope.

This type of cord can be sewn and does not require splicing, which provides a significant simplification in the manufacturing process.

In accordance with the invention it is possible to manufacture ropes that look similar to turned ropes and that are comprised of high-strength Aramid fibers and heat-resistant Nomex fibers. Such ropes can be sewn at the cut location and therefore do not need to be spliced. In addition, such ropes do not fray at the cut location.

The invention claimed is:

1. A rope-like structure or kernmantel rope, comprising:

at least one core providing a core region of the rope that comprises a plurality of fibers, threads or thread bundles as core fibers; and at least one sheath forming a sheath region of the rope that surrounds the core region and that has a plurality of fibers, threads and thread bundles as sheath fibers, wherein a proportion of the core fibers, being part of the core region, is arranged in the sheath region and connected therein to the sheath fibers and wherein a proportion of the sheath fibers, being part of the sheath region, is arranged in the core region and connected therein to the core fibers so that at least one sheath is connected to at least one core as well as relative to each other in a non-slip manner.

2. The rope-like structure or kernmantel rope according to claim 1 wherein the core is comprised of high-performance fibers with resistance to extension and a high degree of resistance to tearing and wherein at least the one sheath is comprised of abrasion-, edge-tear-, shear-, heat- and/or flame-resistant fibers so that at least one sheath is connected to the core in a non-slip manner with different fiber properties.

3. The rope-like structure or kernmantel rope according to claim 1 wherein it is a dynamic rope in which the core is comprised of many fine high-performance fibers that allow for absorption of dynamic shocks while the fibers of at least one sheath provide abrasion-, moisture- and shear-resistant properties so that at least one sheath is connected to the core in a non-slip manner even with different fiber properties.

4. The rope-like structure or kernmantel rope according to claim 1 wherein it is a static rope in which the core is comprised of very high-strength high-performance fibers with tear resistance and wherein the fibers of at least one sheath provide abrasion-, moisture- and shear-resistant properties so that at least one sheath is connected to the core in a non-slip manner even with different fiber properties.

5. The rope-like structure or kernmantel rope according to claim 1 wherein it is a static rope in which the core has high-strength high-performance fibers that provide a degree of tear resistance, wherein an intermediate sheath with fibers that are different or identical to those of the core or the sheath has a net-like structure that allows for the formation of an air cushion under the sheath and, paired with the small diameters, have smaller air resistance wherein core, intermediate sheath and sheath are connected to each other in a manner that ensures that at least one of the sheaths is connected to each other and to the core in a non-slip manner even with different fiber properties.

6. The rope-like structure or kernmantel rope according to claim 1 wherein the core and at least the one sheath are comprised of the same fibers, threads or thread bundles.

7. The rope-like structure or kernmantel rope according to claim 1 wherein the core is made of high-strength Aramid fibers and at least one sheath is comprised of heat-resistant Nomex fibers.

8. The rope-like structure or kernmantel rope according to claim 1 wherein the ratings of the rope are incorporated as fibers into the sheath structure or the sheath.

9. The rope-like structure or kernmantel rope according to claim 1 wherein the share of the core fibers in at least one sheath region is less than 3%.

10. The rope-like structure or kernmantel rope according to claim 1 wherein the share of the core fibers in at least one sheath region and the share of the sheath fibers in the core region is less than 3%.

11. The rope-like structure or kernmantel rope according to claim 1 wherein the share of the core fibers in at least one sheath region is less than 30%.

12. The rope-like structure or kernmantel rope according to claim 1 wherein the share of the core fibers in at least one sheath region and the share of the sheath fibers in the core region is less than 30%.

13. The rope-like structure or kernmantel rope according to claim 1 wherein the share of the core fibers in at least one sheath region ranges between 30% and 50%.

14. The rope-like structure or kernmantel rope according to claim 1 wherein the share of the core fibers in at least one sheath region and the share of the sheath fibers in the core region ranges between 30% and 50%.

15. Use of the rope-like structure or kernmantel rope according to claim 1 in the field of work safety, in water, sailing, and mountain sports applications and for fire service, armed forces, police and rescue units.

16. Use of the rope-like structure or kernmantel rope according to claim 1 as traction rope, as traction rope with bending stress, for lowering devices and reels, for elevators and for crash safety.

17. A rope-like structure or cord similar to a turned or braided cord, comprising:

at least one core providing a core region of the cord that comprises a plurality of fibers, threads or thread bundles as core fibers; and at least one sheath forming a sheath region of the cord that surrounds the core region and that has a plurality of fibers, threads and thread bundles as sheath fibers, wherein a proportion of the core fibers, being part of the core region, is arranged in the sheath region and connected therein to the sheath fibers and wherein a proportion of the sheath fibers, being part of the sheath region, is arranged in the core region and connected therein to the core fibers so that at least one sheath is connected to at least one core as well as relative to each other in a non-slip manner.

18. The rope-like structure or cord according to claim 17 wherein it looks similar to a fishbone pattern, a turned or braided rope and wherein it does not fray or unravel when cut.

19. The rope-like structure or cord according to claim 17 wherein it can be sewn and does not require splicing.

20. The rope-like structure or cord according to claim 17 wherein it is comprised of high-performance fibers with dimensional stability, has good slide properties and a high degree of abrasion resistance and wherein it has a proportion of anti-static yarns and therefore has anti-static properties.

21. Use of the rope-like structure or cord according to claim 20 as a harness cord in Jacquard machines.

22. A rope-like structure or rope, comprising:

at least one core providing a core region of the rope that comprises a plurality of fibers, threads or thread bundles as core fibers; and at least one sheath forming a sheath region of the rope that surrounds the core region and that has a plurality of fibers, threads and thread bundles as sheath fibers, wherein a proportion of the core fibers, being part of the core region, is arranged in the sheath region and connected therein to the sheath fibers and wherein a proportion of the sheath fibers, being part of the sheath region, is arranged in the core region and connected therein to the core fibers so that at least one sheath is connected to at least one core as well as relative to each other in a non-slip manner.

23. The rope-like structure or rope according to claim 22 wherein it looks similar to a turned rope and wherein it is comprised of high-strength Aramid fibers and heat-resistant Nomex fibers.

24. The rope-like structure or rope according to claim 23 wherein the rope-like structure or rope can be sewn at the cut location, does not require splicing and does not unravel.

* * * * *